United States Patent [19]

Broughton

[11] 4,450,937

[45] May 29, 1984

[54] THEFT PREVENTION STEP LADDER

[76] Inventor: Ralph W. Broughton, 233 Val Vista Rd., Space 369, Mesa, Ariz. 85203

[21] Appl. No.: 460,256

[22] Filed: Jan. 24, 1983

Related U.S. Application Data

[63] Continuation-in-part of Ser. No. 351,347, Jun. 14, 1982, abandoned.

[51] Int. Cl.[3] ..... E06C 7/00; E06C 1/36

[52] U.S. Cl. ..... 182/206; 182/106; 182/129; 182/230

[58] Field of Search ..... 182/106, 230, 206, 165, 182/129

[56] References Cited

U.S. PATENT DOCUMENTS

| | | | |
|---|---|---|---|
| 814,904 | 3/1906 | Emory | 182/32 |
| 3,225,863 | 12/1965 | Ludlow | 182/230 |
| 4,181,195 | 1/1980 | Clarke | 182/129 |

*Primary Examiner*—Reinaldo P. Machado
*Attorney, Agent, or Firm*—Warren F. B. Lindsley

[57] ABSTRACT

A step ladder for detachably mounting in a locked arrangement along the length of the permanent ladder of a recreational vehicle for preventing thieves from climbing to the top of the recreational vehicle, said step ladder having a smooth surface along its back support which is exposed when mounted on the permanent ladder to prevent use of the permanent ladder.

4 Claims, 4 Drawing Figures

THEFT PREVENTION STEP LADDER

BACKGROUND OF THE INVENTION

This application is a continuation-in-part of application, Ser. No. 351,347, filed June 14, 1982 now abandoned and entitled THEFT PREVENTION STEP LADDER.

Recreational vehicles are usually provided with a permanent ladder mounted on its rear for providing access to its roof. These ladders have been used by thieves for entering the vehicle through roof vents.

Thus, a need exists for eliminating this illegal access to the roof and since most recreational vehicle users carry a step ladder with them, it is desirable to modify the step ladder and to mount it on the vehicle in a given way to prevent unauthorized access to the top of the vehicle along its permanent ladder.

DESCRIPTION OF THE PRIOR ART

No known prior art exists.

SUMMARY OF THE INVENTION

DESCRIPTION OF THE PREFERRED EMBODIMENT

Referring more particularly to the drawings by characters of reference, FIG. 1 and 2 disclose an ordinary wooden or aluminum step ladder 1; in this particular case, five feet in length, which is the most suitable length for use around a recreational vehicle and for the purpose hereinafter explained.

Figure 1:
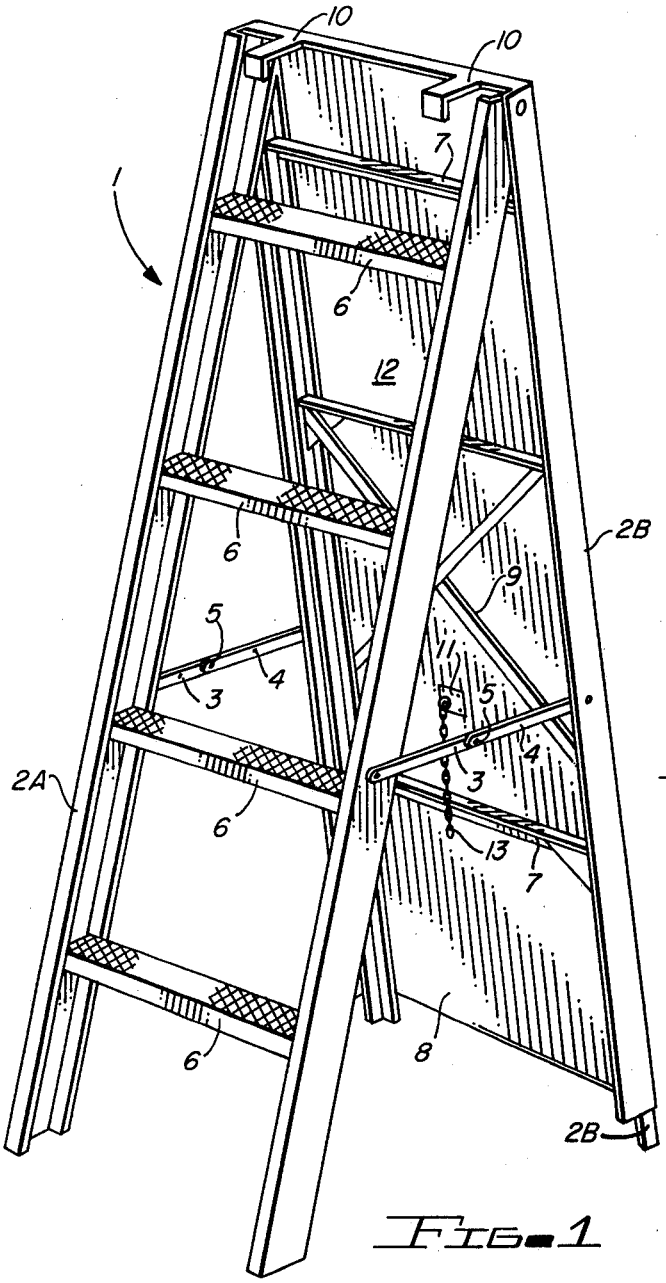
FIG. 1 is a front perspective view of a step ladder embodying the invention.
Figure 2:
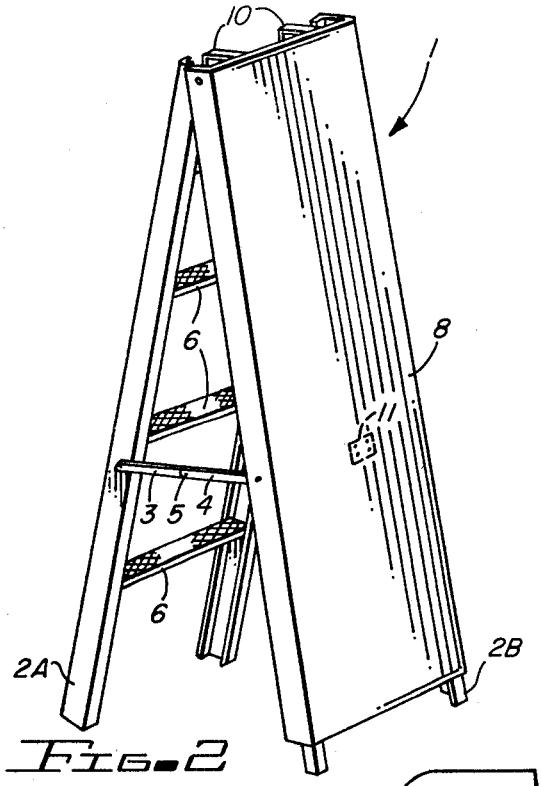
FIG. 2 is a back perspective view of FIG. 1.

Ladder 1 comprises a pair of longitudinal frame members 2A and 2B which are hingedly connected at their top ends so as to pivotally move to their extended positions shown in FIGS. 1 and 2 where it is maintained erected by a pair of extended cross braces. These cross braces each comprise a pair of links 3 and 4 pivotally connected at one end to each other at 5 which their other ends connected one to each of the frame members 2A and 2B, as shown. One of the links of each of the pairs may be provided with a flange along one of its edges to prevent it from moving over center in its extended position in a manner well known in the art.

Frame member 2A is provided with a plurality of treads or steps 6 which are laterally spacedly positioned across the frame along its length.

Frame member 2B is provided with one or more laterally positioned cross braces 7 spacedly arranged across its frame for reinforcing the frame member.

In accordance with the teachings of this invention, a thin sheet or plate of fiber glass, aluminum or any other lightweight suitable skin like material 8 is fastened along substantially the full length of frame member 2B or any suitable portion thereof. This material is suitably fastened to the exposed surface of the frame member with either it or the frame member reinforced by a cross brace 9, as shown in FIG. 1.

As noted in FIG. 2, material 8 provides a smooth outer surface along the length of the back of the step ladder.

A pair of hooks 10 are fastened to the top end of step ladder 1 connected to either, or both, of frame members 2A and 2B to extend outwardly of the planar surface of frame member 2A for use in clamping the step ladder on the top rung of the permanent ladder mounted on the rear of a recreational vehicle.

A plate 11 is mounted to the inside, non-exposed, surface 12 of material 8 to which suitably attached a link chain 13.

Figure 3:
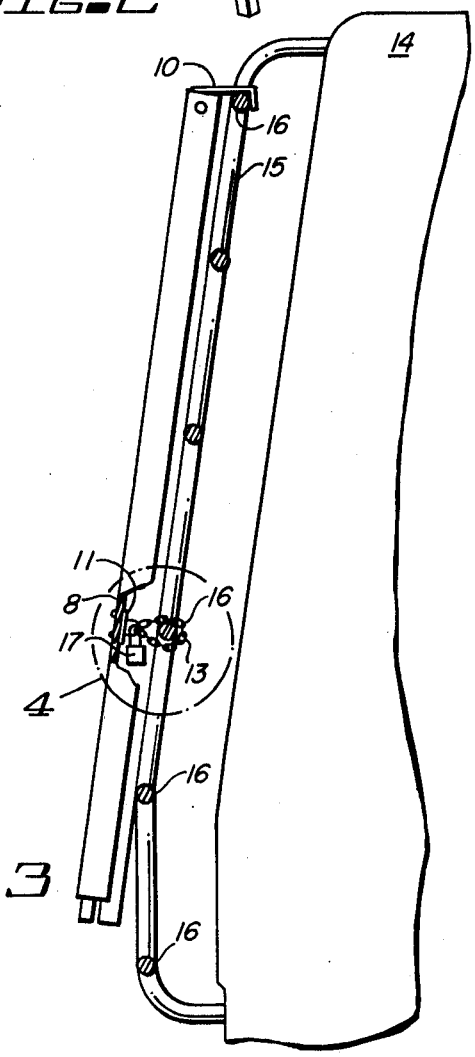
FIG. 3 is an end view of the ladder shown in FIGS. 1 and 2 mounted on the permanent ladder of a recreational vehicle.

FIG. 3 illustrates the rear of a recreational vehicle 14 to which is permanently attached a ladder 15 providing access to the top of the vehicle. This ladder is being used by thieves to climb the top of the vehicle for illegal entrance into the interior of the vehicle through its vents (not shown) mounted on the top of the vehicle.

Ladder 15 is provided with a plurality of rungs 16 spacedly positioned along its length.

In order to avoid unauthorized use of ladder 15, step ladder 1, modified in accordance with the teachings of this invention to include the skin like material 8 along its back surface, is mounted on the permanent ladder 15 with frame 2B and the flat, smooth surface of material 8 exposed.

Figure 4:
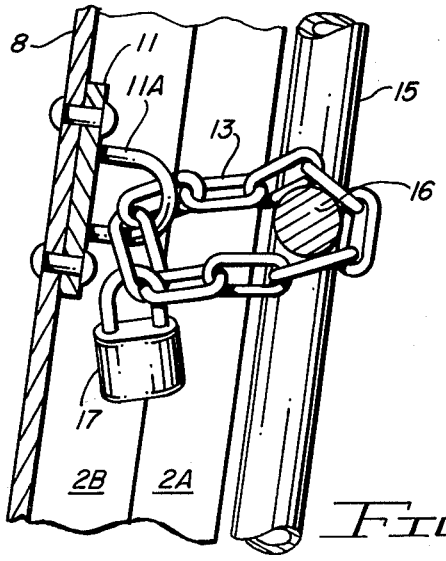
FIG. 4 is an enlarged view of the circled area of FIG. 3.

As shown in FIG. 3, hooks 10 are hooked over the top rung 16 of the permanent ladder mounting and supporting step ladder 1 on permanent ladder 15. Chain 13 is then looped around a juxtapositioned rung 16 or ladder 15 and connected back through lug 11A of plate 11 with its ends connected together by a padlock 17, as shown in FIG. 4.

Thus, it should be noted that the back side of the step ladder with the smooth skin like surface of material 8 covering substantially all of the rungs of the permanent ladder 15 forming a part of the recreational vehicle 14 prevents the use of ladder 15 by an unauthorized user.

Although but one embodiment of the invention has been illustrated and described, it will be apparent to those skilled in the art that various changes and modifications may be made therein without departing from the spirit of the invention or from the scope of the appended claims.

What is claimed is:

1. A step ladder for detachably mounting along the length of a permanent ladder mounted on the outside of a recreational vehicle for preventing use of the permanent ladder to gain access to the roof of the vehicle comprising:

a pair of elongated frame members hingedly connected at common ends thereof forming the top of the step ladder and when pivotally moved to an angular position, forming a free standing structure, one of said frame members having a plurality of spacedly positioned steps arranged laterally thereof along its length, at least one hook member mounted on the common pivotally connected ends of said frame members to extend laterally outwardly thereof, a flat sheet mounted on said other of said frame members for covering substantially its length, said flat sheet providing a smooth outer exposed surface, and locking means mounted on the inside surface of said sheet for detachable engagement with the permanent ladder of a recreational vehicle, whereby when said hook of said step ladder is mounted on the top rung of the ladder on an outside surface of a recreational vehicle with said steps of the step ladder juxtapositioned to the steps of the permanent ladder, said sheet prohibits use of the rungs of the permanent ladder to gain access to the roof of the vehicle.

2. The step ladder set forth in claim 1 wherein:

said locking means comprises a plate means fastened to the inside surface of said sheet and a link chain connected to said plate means and passing around a part of the permanent ladder of the vehicle, and a padlock for connecting the free end of the link chain together.

3. The step ladder set forth in claim 1 wherein:

said sheet is formed of aluminum.

4. The step ladder set forth in claim 1 wherein:

said sheet is formed of fiber glass.

* * * * *